US010701483B2

(12) United States Patent
Li

(10) Patent No.: US 10,701,483 B2
(45) Date of Patent: Jun. 30, 2020

(54) SOUND LEVELING IN MULTI-CHANNEL SOUND CAPTURE SYSTEM

(71) Applicant: DOLBY LABORATORIES LICENSING CORPORATION, San Francisco, CA (US)

(72) Inventor: Chunjian Li, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/475,859

(22) PCT Filed: Jan. 3, 2018

(86) PCT No.: PCT/US2018/012247
§ 371 (c)(1),
(2) Date: Jul. 3, 2019

(87) PCT Pub. No.: WO2018/129086
PCT Pub. Date: Jul. 12, 2018

(65) Prior Publication Data

US 2019/0349679 A1 Nov. 14, 2019

Related U.S. Application Data

(60) Provisional application No. 62/445,926, filed on Jan. 13, 2017.

(30) Foreign Application Priority Data

Jan. 3, 2017 (CN) ..... 2017 1 0001196
Feb. 10, 2017 (EP) ..... 17155649

(51) Int. Cl.
*H04R 3/00* (2006.01)

(52) U.S. Cl.
CPC ..... *H04R 3/005* (2013.01); *H04R 2430/01* (2013.01)

(58) Field of Classification Search
CPC .. H04S 2400/01; H04S 2400/03; H04S 3/008; H04S 1/007; H04S 2400/11;
(Continued)

(56) References Cited

U.S. PATENT DOCUMENTS 4,630,305 A 12/1986 Borth
6,002,776 A 12/1999 Bhadkamkar
(Continued)

FOREIGN PATENT DOCUMENTS

CN 102047326 5/2011
CN 102047688 5/2011
(Continued)

OTHER PUBLICATIONS

Dmochowski, J. et al "Direction of Arrival Estimation Using the Parameterized Spatial Correlation Matrix", IEEE Trans. Audio Speech Language Process, vol. 15, No. 4, pp. 1327-1339, May 2007.

(Continued)

*Primary Examiner* — Lun-See Lao

(57) ABSTRACT

Embodiments of sound leveling in multi-channel sound capture system are disclosed. According to a method, a processor converts at least two input sound channels captured via a microphone array into at least two intermediate sound channels. The intermediate sound channels are respectively associated with predetermined directions from the microphone array. The closer to the direction a sound source is, the more the sound source is enhanced in the intermediate sound channel associated with the direction. The processor levels the intermediate sound channels separately. Further, the processor converts the intermediate
(Continued)

sound channels subjected to leveling to a predetermined output channel format. Because sound leveling of the intermediate sound channels can be achieved independently of each other, at least some of the deficiencies of the conventional gain regulation can be overcome or mitigated.

16 Claims, 8 Drawing Sheets

(58) Field of Classification Search
CPC ..... H04S 2420/01; H04S 2420/03; H04S 2400/13; H04S 2400/15; H04S 2420/07; H04S 2420/11; H04S 7/30; H04S 7/303; G10L 19/008; G10L 19/002; G10L 19/032; G10L 19/06; G10L 19/09; G10L 19/24; G10L 25/03; G10L 25/21; G10L 25/51; G10L 19/167; G10L 19/20; G10L 15/063; G10L 15/16; G10L 15/22; G10L 17/22; G10L 2015/088; G10L 2015/223; H04M 3/5116; H04M 15/00; H04M 15/765; H04M 15/80; H04M 1/0264; H04M 2203/355; H04M 2250/12; H04M 3/4217; H04R 3/005; H04R 1/1008; H04R 1/1091; H04R 1/406; H04R 2400/03; H04R 2430/01; H04R 2430/23; H04R 3/04; A61K 38/1738; A61K 45/06
USPC ..... 381/92, 123, 91, 56–58, 300, 81, 77, 76, 381/79, 1–3, 61, 63; 700/94; 348/1–14.09; 455/130, 205, 150.1, 455/151.1–151, 4
See application file for complete search history.

(56) References Cited

U.S. PATENT DOCUMENTS

| | | | | |
|---|---|---|---|---|
| 7,227,566 | B2 * | 6/2007 | Abe | H04N 7/15 348/14.05 |
| 7,983,907 | B2 | 7/2011 | Visser | |
| 7,991,163 | B2 * | 8/2011 | Loether | H04R 27/00 348/14.01 |
| 9,626,970 | B2 * | 4/2017 | Huang | G10L 25/03 |
| 10,553,236 | B1 * | 2/2020 | Ayrapetian | G10L 21/0232 |
| 2003/0059061 | A1 * | 3/2003 | Tsuji | H04M 3/569 381/92 |
| 2009/0190774 | A1 | 7/2009 | Wang | |
| 2009/0281802 | A1 | 11/2009 | Thyssen | |
| 2015/0215467 | A1 | 7/2015 | Shue | |
| 2016/0094910 | A1 | 3/2016 | Vallabhan | |

FOREIGN PATENT DOCUMENTS

| | | |
|---|---|---|
| CN | 102948168 | 2/2013 |
| EP | 1489882 | 12/2004 |
| JP | 07240990 | 9/1995 |
| JP | 9307383 | 11/1997 |
| WO | 2007049222 | 5/2007 |

OTHER PUBLICATIONS

Khaddour, H. "Estimation of Direction of Arrival of Multiple Sound Sources in 3D Space Using B-Format" vol. 2, No. 2, International Journal of Advances in Telecommunications, Electrotechnics, Signals and Systems, 2013, pp. 63-67.

* cited by examiner

SOUND LEVELING IN MULTI-CHANNEL SOUND CAPTURE SYSTEM

TECHNICAL FIELD

Example embodiments disclosed herein relate to audio signal processing. More specifically, example embodiments relate to leveling in multi-channel sound capture systems.

BACKGROUND

Sound leveling in sound capturing systems is known as a process of regulating the sound level so that it meets system dynamic range requirement or artistic requirements. Conventional sound leveling techniques, such as Automatic Gain Control (AGC), apply one adaptive gain (or one gain for each frequency band, if in a sub-band implementation) that changes over time. The gain is applied to amplify or attenuate the sound if the measured sound level is too low or too high.

SUMMARY

Example embodiments disclosed herein describe a method of processing audio signals. According to the method, a processor converts at least two input sound channels captured via a microphone array into at least two intermediate sound channels. The intermediate sound channels are respectively associated with predetermined directions from the microphone array. The closer to the direction a sound source is, the more the sound source is enhanced in the intermediate sound channel associated with the direction. The processor levels the intermediate sound channels separately. Further, the processor converts the intermediate sound channels subjected to leveling to a predetermined output channel format.

Example embodiments disclosed herein also describe an audio signal processing device. The audio signal processing device includes a processor and a memory. The memory is associated with the processor and includes processor-readable instructions. When the processor reads the processor-readable instructions, the processor executes the above method of processing audio signals.

Example embodiments disclosed herein also describe an audio signal processing device. The audio signal processing device includes at least one hardware processor. The processor can execute a first converter, a leveler and a second converter. The first converter is configured to convert at least two input sound channels captured via a microphone array into at least two intermediate sound channels. The intermediate sound channels are respectively associated with predetermined directions from the microphone array. The closer to the direction a sound source is, the more the sound source is enhanced in the intermediate sound channel associated with the direction. The leveler is configured to level the intermediate sound channels separately. The second converter is configured to convert the intermediate sound channels subjected to leveling to a predetermined output channel format.

Further features and advantages of the example embodiments disclosed herein, as well as the structure and operation of the example embodiments, are described in detail below with reference to the accompanying drawings. It is noted that the example embodiments are presented herein for illustrative purposes only. Additional embodiments will be apparent to persons skilled in the relevant art(s) based on the teachings contained herein.

BRIEF DESCRIPTION OF DRAWINGS

Embodiments disclosed herein are illustrated by way of example, and not by way of limitation, in the figures of the accompanying drawings and in which like reference numerals refer to similar elements and in which.

DETAILED DESCRIPTION

Figure 1A:
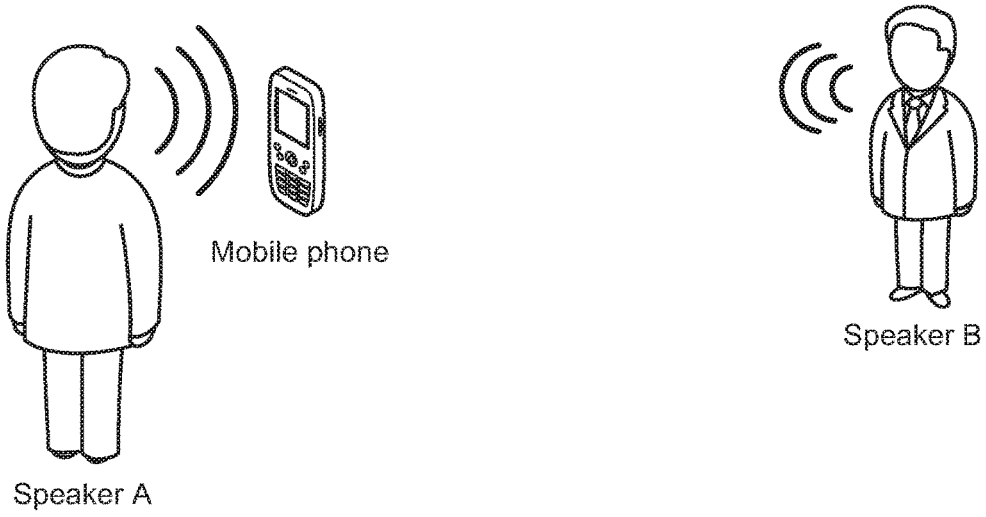
FIG. 1A is a schematic view for illustrating an example scenario of sound capture.

The example embodiments are described by referring to the drawings. It is to be noted that, for purpose of clarity, representations and descriptions about those components and processes known by those skilled in the art but unrelated to the example embodiments are omitted in the drawings and the description.

As will be appreciated by one skilled in the art, aspects of the example embodiments may be embodied as a system, method or computer program product. Accordingly, aspects of the example embodiments may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the example embodiments may take the form of a computer program product tangibly embodied in one or more computer readable medium(s) having computer readable program code embodied thereon.

Aspects of the example embodiments are described below with reference to flowchart illustrations and/or block diagrams of methods, apparatus (as well as systems) and computer program products. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

FIG. 1A is a schematic view for illustrating an example scenario of sound capture. In this scenario, a mobile phone is capturing a sound scene where speaker A holding the mobile phone is in a conversation with speaker B in the front of the phone camera at a distance. Since speaker A is much closer to the mobile phone than speaker B he is photographing, the recorded sound level alternates between closer and farther sound sources with large level difference.

Figure 1B:
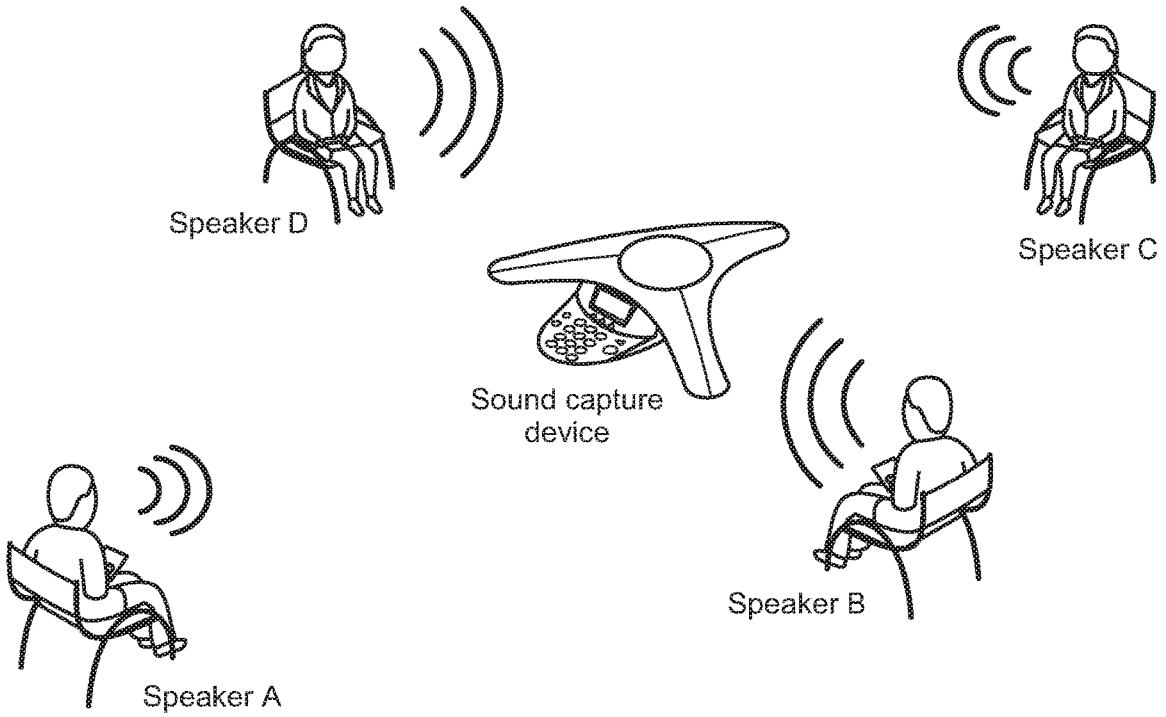
FIG. 1B is a schematic view for illustrating another example scenario of sound capture.

FIG. 1B is a schematic view for illustrating another example scenario of sound capture. In this scenario, a sound capture device is capturing a sound scene of conference, where speakers A, B, C and D are in a conversation, via the sound capture device, with others participating in the conference but locating at a remote site. Speakers B and D are much closer to the sound capture device than speakers A and C due to, for example, the arrangement of the sound capture device and/or seats, and thus the recorded sound level alternates between closer and farther sound sources with large sound level difference.

With the conventional gain regulation, when sounds come alternately from a high level sound source and a low level sound source, the AGC gain has to change quickly up and down to amplify the low level sound or attenuate the high level sound, if the aim is to capture a more balanced sound scene. The frequent gain regulations and large gain variations can cause different artifacts. For example, if the adaptation speed of AGC is too slow, the gain changes lag behind the actual sound level changes. This can cause misbehaviors where parts of the high level sound are amplified and parts of the low level sound are attenuated. If the adaptation speed of AGC is set very fast to catch the sound source switching, the natural level variation in the sound (e.g., speech) is reduced. The natural level variation of speech, measured by modulation depth, is important for its intelligibility and quality. Another side effect of frequent gain fluctuation is the noise pumping effect, where the relatively constant background noise is pumped up and down in level making an annoying artifact.

In view of the foregoing, a solution is proposed for sound leveling based on an idea of separating the sound scene into separate sound channels and applying independent AGCs to the sound channels. In this way, each AGC can run with a relatively slowly changing gain, since each gain only deals with a source in the associated sound channel.

Figure 2:
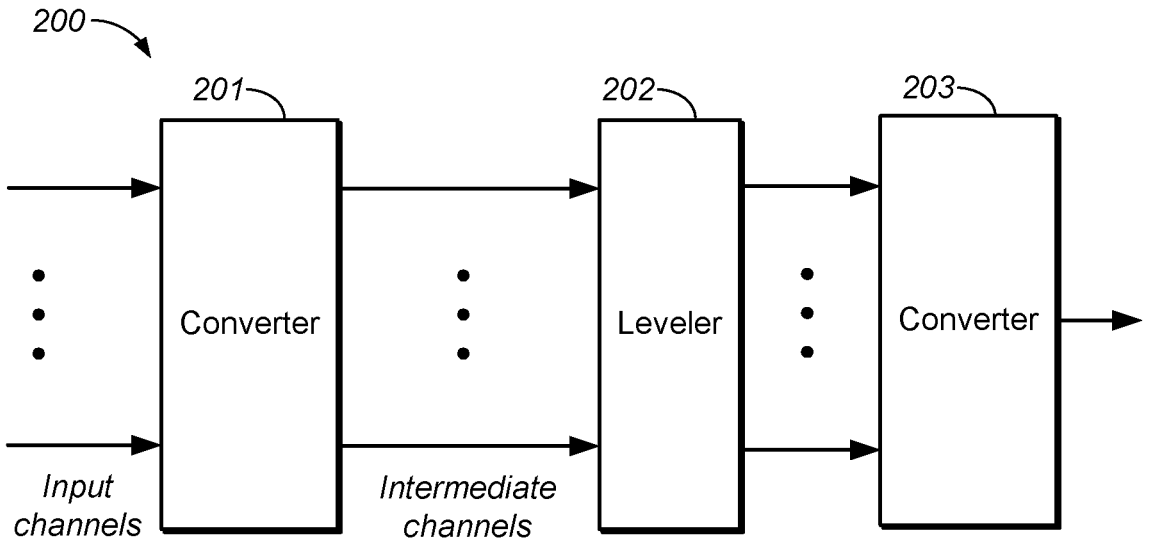
FIG. 2 is a block diagram for illustrating an example audio signal processing device according to an example embodiment.

FIG. 2 is a block diagram for illustrating an example audio signal processing device 200 according to an example embodiment.

According to FIG. 2, the audio signal processing device 200 includes a converter 201, a leveler 202 and a converter 203.

Figure 5A:
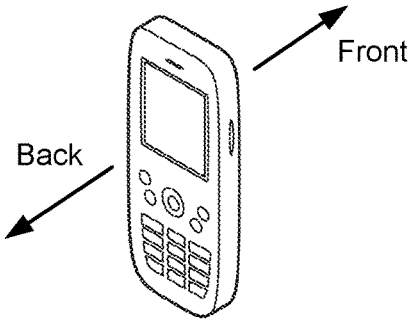
FIG. 5A is a schematic view for illustrating examples of associations of intermediate sound channels with directions from a microphone array in scenarios illustrated in FIG. 1A and FIG. 1B employed in for example a user equipment such as a cell phone.
Figure 5B:
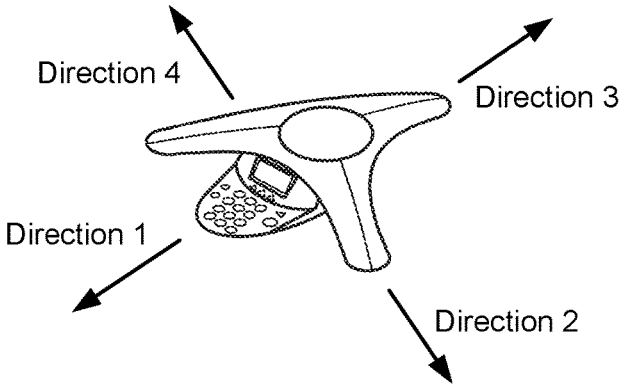
FIG. 5B is a schematic view for illustrating examples of associations of intermediate sound channels with directions from a microphone array in scenarios illustrated in FIG. 1A and FIG. 1B employed in for example a conference phone.

The converter 201 is configured to convert at least two input sound channels captured via a microphone array into at least two intermediate sound channels. The intermediate sound channels are respectively associated with predetermined directions from the microphone array. FIG. 5A/B is a schematic view for illustrating examples of associations of intermediate sound channels with directions from a microphone array in scenarios illustrated in FIG. 1A and FIG. 1B. FIG. 5A illustrates a scenario where the intermediate sound channels include a front channel associated with a front direction at which a camera on the mobile phone points (the camera's orientation), and a back channel associated with a back direction opposite to the front direction. FIG. 5B illustrates a scenario where the intermediate sound channels include four sound channels respectively associated with direction 1, direction 2, direction 3 and direction 4.

Figure 6:
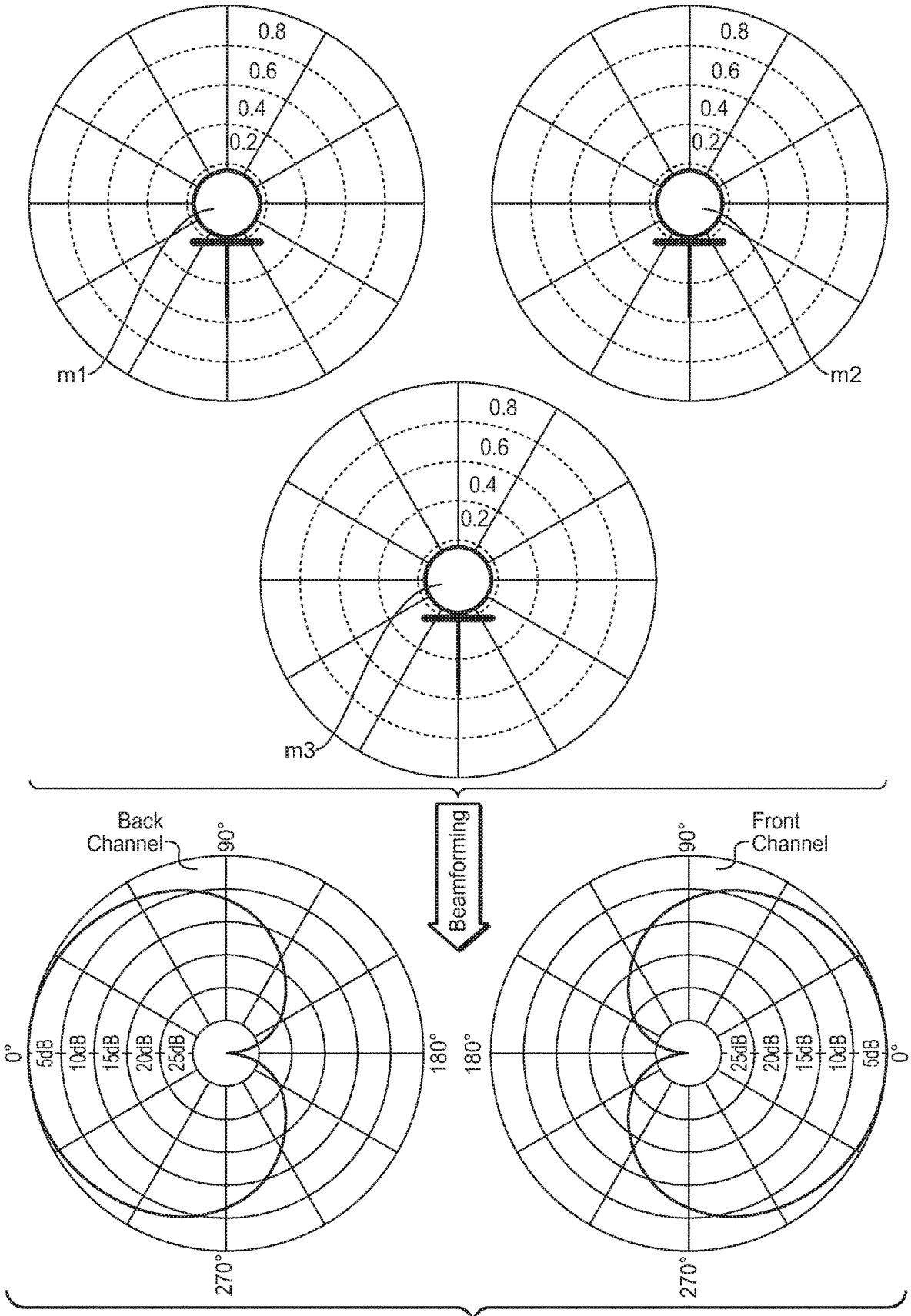
FIG. 6 is a schematic view for illustrating an example of producing intermediate sound channels from input sound channels captured via microphones via beamforming.

In each of the intermediate sound channels, if a sound source is closer to the direction associated with the intermediate sound channel, the sound source is more enhanced in the intermediate sound channel Various methods can be employed to convert the input sound channels into the intermediate sound channels. In an example, the intermediate sound channels may be produced by applying beamforming to input sound channels captured via microphones of a microphone array. In the scenario illustrated in FIG. 5B, for example, a beamforming algorithm takes input sound channels captured via three microphones of the mobile phone and forms a cardioid beam pattern towards the front direction and another cardioid beam pattern towards the back direction. The two cardioid beam patterns are applied to produce the front channel and the back channel. FIG. 6 is a schematic view for illustrating an example of producing intermediate sound channels from input sound channels captured via microphones via beamforming. As illustrated in FIG. 6, three omni-directional microphones m1, m2 and m3 and their directivity patterns are presented. After applying a beamforming algorithm, a front channel and a back channel are produced from input sound channels captured via microphones m1, m2 and m3. Cardioid beam patterns of the front channel and the back channel are also presented in FIG. 6.

The microphone array may be integrated with the audio signal processing device 200 in the same device. Examples of the device include but not limited to sound or video recording device, portable electronic device such as mobile phone, tablet and the like, and sound capture device for conference. The microphone array and the audio signal processing device 200 may also be arranged in separate devices. For example, the audio signal processing device 200 may be hosted in a remote server and input sound channels captured via the microphone array are input to the audio signal processing device 200 via connections such as network or storage medium such as hard disk.

Turning back to FIG. 2, the leveler 202 is configured to level the intermediate sound channels separately. For example, independent gains and target levels may be applied to the intermediate sound channels respectively.

The converter 203 is configured to convert the intermediate sound channels subjected to leveling to a predetermined output channel format. Examples of the predetermined output channel format include but not limited to mono, stereo, 5.1 or higher, and first order or higher order ambisonic. For mono output, for example, the front sound channel and the back sound channel subjected to sound leveling are summed by the converter 203 together to form the final output. For multiple channel output channel format such as 5.1 or higher, for example, the converter 203 pans the front sound channel to the front output channels, and the back sound channel to the back output channels. For stereo output, for example, the front sound channel and the back sound channel subjected to sound leveling are panned by the converter 203 to the front-left/front-right and back-left/back-right channel respectively, and then summed up to form the final output left and right channel.

Because sound leveling of the intermediate sound channels can be achieved independently of each other, at least some of the deficiencies of the conventional gain regulation can be overcome or mitigated.

Figure 3:
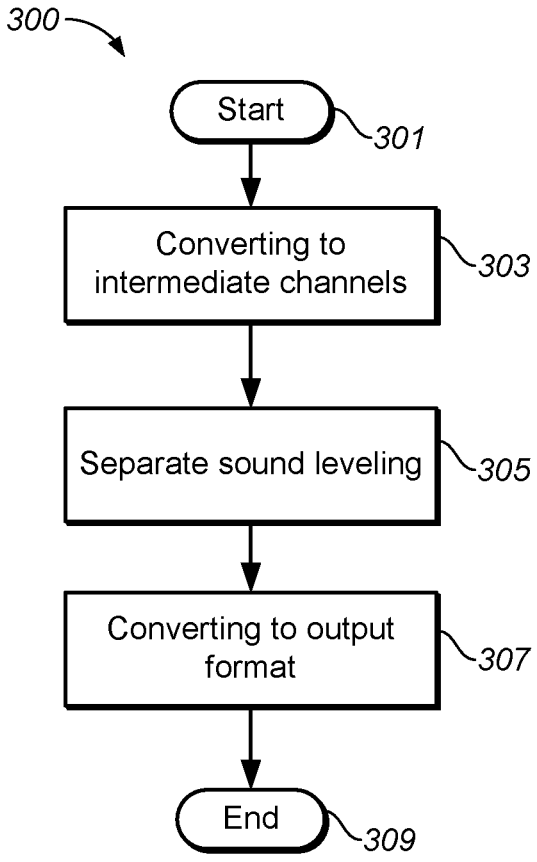
FIG. 3 is a flow chart for illustrating an example method of processing audio signals according to an example embodiment.

FIG. 3 is a flow chart for illustrating an example method 300 of processing audio signals according to an example embodiment.

As illustrated in FIG. 3, the method 600 starts from step 301. At step 303, at least two input sound channels captured via a microphone array are converted into at least two intermediate sound channels. The intermediate sound channels are respectively associated with predetermined directions from the microphone array. In each of the intermediate sound channels, if a sound source is closer to the direction associated with the intermediate sound channel, the sound source is more enhanced in the intermediate sound channel.

At step 305, the intermediate sound channels are leveled separately. For example, independent gains and target levels may be applied to the intermediate sound channels respectively.

At step 307, the intermediate sound channels subjected to leveling are converted to a predetermined output channel format. Examples of the predetermined output channel format include but not limited to mono, stereo, 5.1 or higher, and first order or higher order ambisonic.

Figure 4:
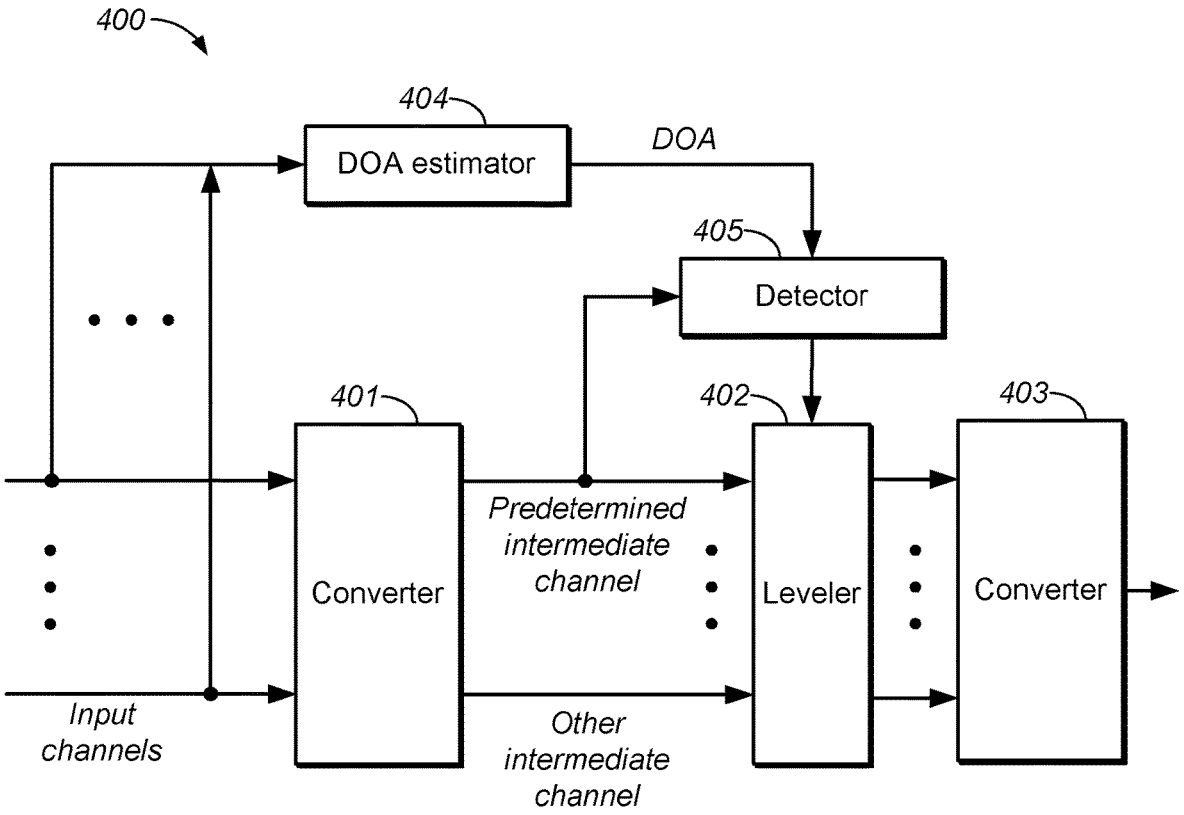
FIG. 4 is a block diagram for illustrating an example audio signal processing device according to an example embodiment.

FIG. 4 is a block diagram for illustrating an example audio signal processing device 400 according to an example embodiment.

According to FIG. 4, the audio signal processing device 400 includes a converter 401, a leveler 402, a converter 403, a direction of arrival estimator 404, and a detector 405. In an example, any of the components or elements of the audio signal processing device 400 may be implemented as one or more processes and/or one or more circuits (for example, application specific integrated circuits (ASICs), field programmable gate arrays (FPGAs), or other integrated circuits), in hardware, software, or a combination of hard ware and software. In another example, the audio signal processing device 400 may include a hardware processor for performing the respective functions of the converter 401, the leveler 402, the converter 403, the direction of arrival estimator 404, and the detector 405.

In an example, the audio signal processing device 400 processes sound frames in a iterative manner. In the current iteration, the audio signal processing device 400 processes sound frames corresponding to one time or time interval. In the next iteration, the audio signal processing device 400 processes sound frames corresponding to the next time or time interval.

The converter 401 is configured to convert at least two input sound channels captured via a microphone array into at least two intermediate sound channels. The intermediate sound channels are respectively associated with predetermined directions from the microphone array. In each of the intermediate sound channels, if a sound source is closer to the direction associated with the intermediate sound channel, the sound source is more enhanced in the intermediate sound channel.

The direction of arrival estimator 404 is configured to estimate a direction of arrival based on input sound frames of the input sound channels captured via the microphone array. The direction of arrival indicates the direction, relative to the microphone array, of a sound source dominating the current sound frame in terms of signal power. An example method of estimating the direction of arrival is described in J. Dmochowski, J. Benesty, S. Affes, "Direction of arrival estimation using the parameterized spatial correlation matrix", *IEEE Trans. Audio Speech Lang. Process.*, vol. 15, no. 4, pp. 1327-1339, May 2007, the contents of which are incorporated herein by reference in their entirety.

The leveler 402 is configured to level the intermediate sound channels separately. For example, independent gains and target levels may be applied to the intermediate sound channels respectively.

The detector 405 is used to identify presence of a sound source, locating near the direction associated with a predetermined intermediate sound channel, in a sound frame of the predetermined intermediate sound channel, so that sound leveling of the sound frame in the predetermined intermediate sound channel can be achieved independently of sound frames in other intermediate sound channels. A predetermined intermediate sound channel may be that associated with a direction in which a sound source closer to the microphone array is expected to present. Alternatively, a predetermined intermediate sound channel may be that associated with a direction in which a sound source farther to the microphone array is expected to present. In this sense, predetermined intermediate sound channels and intermediate sound channels other than the predetermined intermediate sound channels are respectively referred to as "target sound channels" and "non-target sound channels" in the context of the present disclosure. For example, in the scenario illustrated in FIG. 5A, the back channel is a predetermined intermediate sound channel and the front channel is an intermediate sound channel other than the predetermined intermediate sound channel(s), or vice versa. In the scenario illustrated in FIG. 5B, the sound channels associated with direction 2 and direction 4 are predetermined intermediate sound channels and the sound channels associated with direction 1 and direction 3 are intermediate sound channels other than the predetermined intermediate sound channels, or vice versa. In an example, a predetermined intermediate sound channel may be specified based on configuration data or user input.

In an example, the presence can be identified if a sound source presents near the direction associated with the predetermined intermediate sound channel and the sound emitted by the sound source is sound of interest (SOI) other than background noise and microphone noise. For example, the sound of interest may be identified as non-stationary sound. As an example, the signal quality may be used to identify the sound of interest. If the signal quality of a sound frame is higher, there is a larger possibility that the sound frame includes the sound of interest. Various parameters for representing the signal quality can be used.

The instantaneous signal-to-noise ratio (iSNR) for measuring how much the current sound (frame) stands out of the averaged ambient sounds is an example parameter for representing the signal quality.

For example, the iSNR may be calculated by first estimating the noise floor with a minimum level tracker, and then taking the difference between the current frame level and the noise floor in dB.

For example, the iSNR may be calculated as $iSNR_{dB}=P_{sound\ frame,dB}-P_{noise,dB}$, wherein $iSNR_{dB}$, $P_{sound\,frame,dB}$ and $P_{noise,dB}$ represent the instantaneous signal to noise ratio expressed in dB, the power of the current sound frame in dB and the estimated power of the noise floor expressed in dB.

In another example, the iSNR may be calculated by first estimating the noise floor with a minimum level tracker, and then calculating the ratio of the power of the current frame level to the power of the noise floor.

For example, the iSNR may be calculated as iSNR= $P_{sound\ frame}/P_{noise}$, wherein $P_{sound\ frame}$ is the power of the current sound frame, and $P_{noise}$ is the power of the noise floor. The iSNR can also be converted to $iSNR_{dB}$, according to $iSNR_{db}=10\ \log_{10}(iSNR)$.

The power P in these expressions may for example represent an average power.

Figure 7:
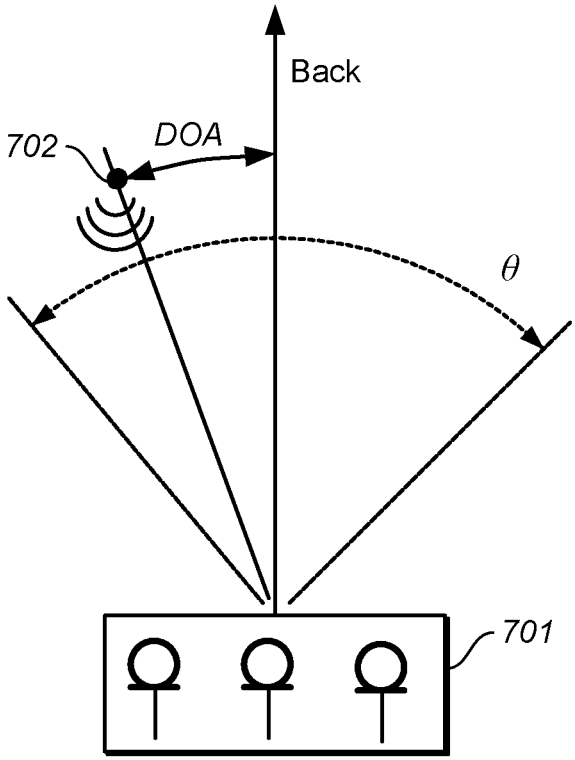
FIG. 7 is a schematic view for illustrating an example scenario of identifying a sound frame according to an example embodiment.

In an example, the detector 405 is configured to estimate the signal quality of a sound frame in each predetermined intermediate sound channel, and identify a sound frame if the following conditions are met: 1) the direction of arrival indicates that a sound source of the sound frame locates within a predetermined range from the direction associated with the predetermined intermediate sound channel including the identified sound frame, and 2) the signal quality is higher than a threshold level. FIG. 7 is a schematic view for illustrating an example scenario of meeting condition 1). As illustrated in FIG. 7, a predetermined intermediate sound channel is associated with a back direction from a microphone array 701. There is an angle range θ around the back direction. The direction of arrival DOA of a sound source 702 falls within the angle range θ, and therefore the condition 1) is met. In condition 1), the sound frame is associated with the same time as the input sound frames for estimating the direction of arrival to ensure that the direction of arrival really indicates the location when the sound source emits the sound of interest in the sound frame.

In an example, more than one direction of arrival may be estimated for more than one sound source at the same time. In this situation, with respect to each direction of arrival, the detector 405 estimate the signal quality of a sound frame in each predetermined intermediate sound channel, and identify a sound frame if the conditions 1) and 2) are met. An example method of estimating more than one direction of arrival is described in H. KHADDOUR, J. SCHIMMEL, M. TRZOS, "Estimation of direction of arrival of multiple sound sources in 3D space using B-format", *International Journal of Advances in Telecommunications, Electrotechnics, Signals and Systems,* 2013, vol. 2, no. 2, p. 63-67, the contents of which are incorporated herein by reference in their entirety.

If a sound frame is identified by the detector 405, the leveler 402 is configured to regulate a sound level of the identified sound frame towards a target level, by applying a corresponding gain. In an example, a conventional method of sound leveling may be applied for each intermediate sound channel other than the predetermined intermediate sound channel(s).

The converter 403 is configured to convert the intermediate sound channels subjected to leveling to a predetermined output channel format.

Because sound leveling gains are calculated based on the identified SOI sound frame in the predetermined intermediate sound channel whereas non SOI frames are excluded, the noise frames are not boosted and the performance of sound leveling is improved.

Figure 8:
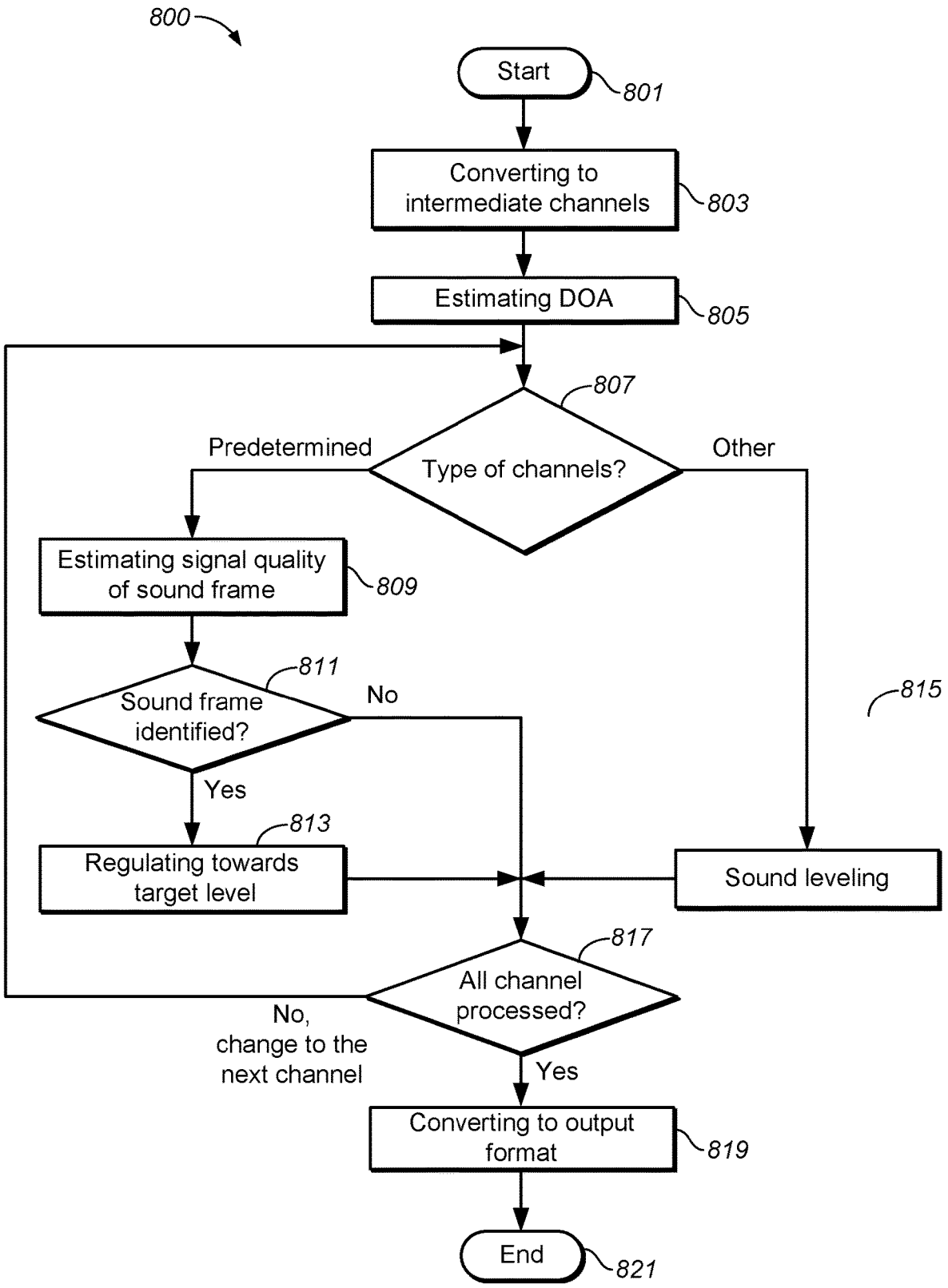
FIG. 8 is a flow chart for illustrating an example method of processing audio signals according to an example embodiment.

FIG. 8 is a flow chart for illustrating an example method 800 of processing audio signals according to an example embodiment.

As illustrated in FIG. 8, the method 800 starts from step 801. At step 803, at least two input sound channels captured via a microphone array are converted into at least two intermediate sound channels. The intermediate sound channels are respectively associated with predetermined directions from the microphone array. In each of the intermediate sound channels, if a sound source is closer to the direction associated with the intermediate sound channel, the sound source is more enhanced in the intermediate sound channel. In an example, the intermediate sound channels may be produced by applying beamforming to input sound channels captured via microphones of a microphone array.

At step 805, a direction of arrival is estimated based on input sound frames of the input sound channels captured via the microphone array.

At step 807, it is determined whether a current one of the intermediate sound channels is a predetermined intermediate sound channel or not. A predetermined intermediate sound channel may be that associated with a direction in which a sound source closer to the microphone array is expected to present. Alternatively, a predetermined intermediate sound channel may be that associated with a direction in which a sound source farther to the microphone array is expected to present. In an example, a predetermined intermediate sound channel may be specified based on configuration data or user input.

If the intermediate sound channel is not a predetermined intermediate sound channel, then the method 800 proceeds to step 815. If the intermediate sound channel is a predetermined intermediate sound channel, then at step 809, the signal quality of a sound frame in the predetermined intermediate sound channel is estimated.

At step 811, presence of a sound source, locating near the direction associated with the predetermined intermediate sound channel, in a sound frame of the predetermined intermediate sound channel is identified. In an example, the presence can be identified if a sound source presents near the direction associated with the predetermined intermediate sound channel and the sound emitted by the sound source is sound of interest (SOI) other than background noise and microphone noise. For example, the sound of interest may be identified as non-stationary sound. As an example, the signal quality may be used to identify the sound of interest. If the signal quality of a sound frame is higher, there is a larger possibility that the sound frame includes the sound of interest. In an example, the signal quality of a sound frame in the predetermined intermediate sound channel is estimated, and a sound frame is identified if the following conditions are met: 1) the direction of arrival indicates that a sound source of the sound frame locates within a predetermined range from the direction associated with the predetermined intermediate sound channel including the identified sound frame, and 2) the signal quality is higher than a threshold level. In condition 1), the sound frame is associated with the same time as the input sound frames for estimating the direction of arrival to ensure that the direction of arrival really indicates the location when the sound source emits the sound of interest in the sound frame.

In an example, more than one direction of arrival may be estimated for more than one sound source at the same time. In this situation, with respect to each direction of arrival, the signal quality of a sound frame in the predetermined intermediate sound channel is estimated, and a sound frame is identified if the conditions 1) and 2) are met.

If a sound frame is not identified, then the method 800 proceeds to step 817. If a sound frame is identified, then at step 813, a sound level of the identified sound frame is regulated towards a target level, by applying a corresponding gain.

At step 817, it is determined whether all the intermediate sound channels have been processed. If not, the method 800 proceeds to step 807 and changes the current intermediate sound channel to the next intermediate sound channel waiting for processing. If all the intermediate sound channels have been processed, the method 800 proceeds to step 819.

At step 815, sound leveling is applied to the current intermediate sound channel. Then the method 800 proceeds to step 817. A conventional method of sound leveling may be applied. For example, an independent gain and an independent target level may be applied to the current intermediate sound channel.

At step 819, the intermediate sound channels subjected to leveling are converted to a predetermined output channel format. Examples of the predetermined output channel format include but not limited to mono, stereo, 5.1 or higher, and first order or higher order ambisonic. Then the method 800 ends at step 821.

Figure 9:
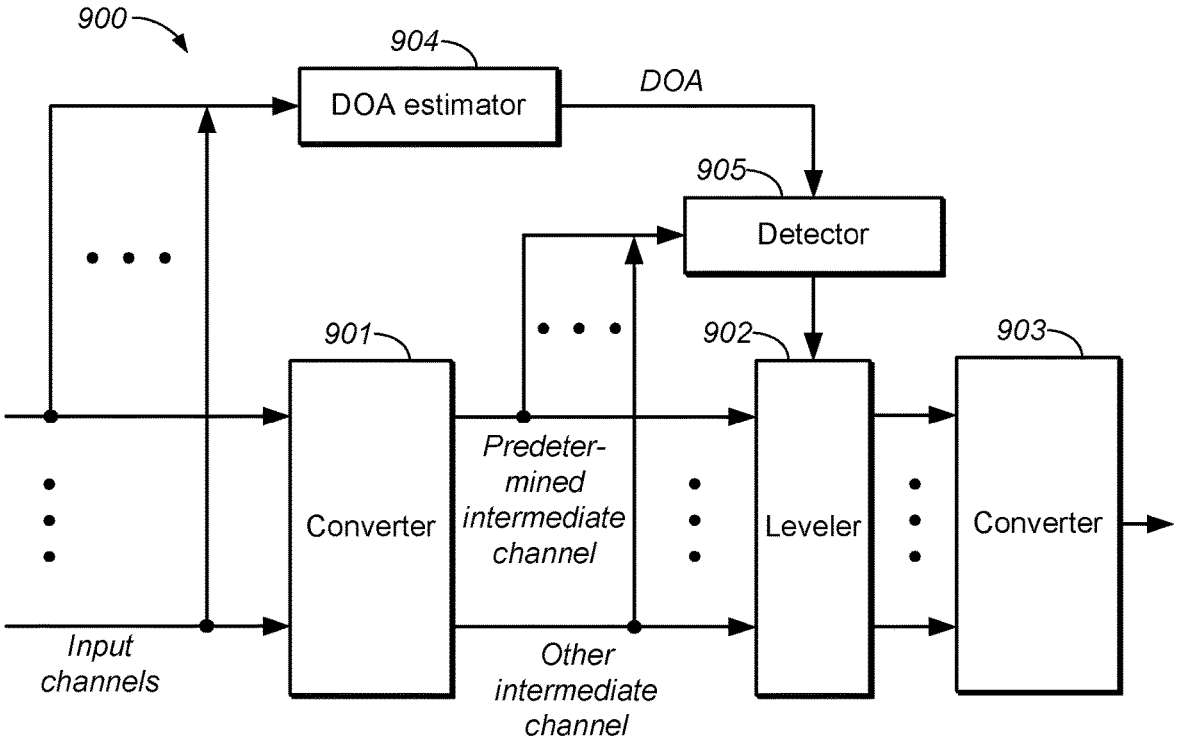
FIG. 9 is a block diagram for illustrating an example audio signal processing device according to an example embodiment.

FIG. 9 is a block diagram for illustrating an example audio signal processing device 900 according to an example embodiment.

According to FIG. 9, the audio signal processing device 900 includes a converter 901, a leveler 902, a converter 903, a direction of arrival estimator 904, and a detector 905.

In an example, the audio signal processing device 900 processes sound frames in a iterative manner. In the current iteration, the audio signal processing device 900 processes sound frames corresponding to one time or time interval. In the next iteration, the audio signal processing device 900 processes sound frames corresponding to the next time or time interval.

The converter 901 is configured to convert at least two input sound channels captured via a microphone array into at least two intermediate sound channels. The intermediate sound channels are respectively associated with predetermined directions from the microphone array. In each of the intermediate sound channels, if a sound source is closer to the direction associated with the intermediate sound channel, the sound source is more enhanced in the intermediate sound channel.

The direction of arrival estimator 904 is configured to estimate a direction of arrival based on input sound frames of the input sound channels captured via the microphone array. The leveler 902 is configured to level the intermediate sound channels separately.

For a predetermined intermediate sound channel, the detector 905 is used to identify presence of a sound source, locating near the direction associated with the predetermined intermediate sound channel, in a sound frame of the predetermined intermediate sound channel, so that sound leveling of the sound frame in the predetermined intermediate sound channel can be achieved independently of sound frames in other intermediate sound channels. In an example, the detector 905 is configured to estimate the signal quality of a sound frame in each predetermined intermediate sound channel, and identify a sound frame if the following conditions are met: 1) the direction of arrival indicates that a sound source of the sound frame locates within a predetermined range from the direction associated with the predetermined intermediate sound channel including the identified sound frame, and 2) the signal quality is higher than a threshold level. In condition 1), the sound frame is associated with the same time as the input sound frames for estimating the direction of arrival to ensure that the direction of arrival really indicates the location when the sound source emits the sound of interest in the sound frame.

For an intermediate sound channel other than the predetermined intermediate sound channel(s), the detector 905 is used to identify that the sound emitted by a sound source is sound of interest (SOI) other than background noise and microphone noise. In an example, the detector 905 is configured to estimate the signal quality of a sound frame in each intermediate sound channel other than the predetermined intermediate sound channel(s), and identify a sound frame if the signal quality is higher than a threshold level.

If a sound frame in a predetermined intermediate sound channel is identified by the detector 905, the leveler 902 is configured to regulate a sound level of the identified sound frame towards a target level, by applying a corresponding gain. If a sound frame in an intermediate sound channel other than the predetermined intermediate sound channel(s) is identified by the detector 905, the leveler 902 is configured to regulate a sound level of the identified sound frame towards another target level, by applying a corresponding gain.

The converter 903 is configured to convert the intermediate sound channels subjected to leveling to a predetermined output channel format.

Because sound leveling of the identified sound frame in the intermediate sound channel(s) other than the predetermined intermediate sound channel(s) can be achieved independently of background noise and microphone noise, the performance of sound leveling is improved.

Figure 10:
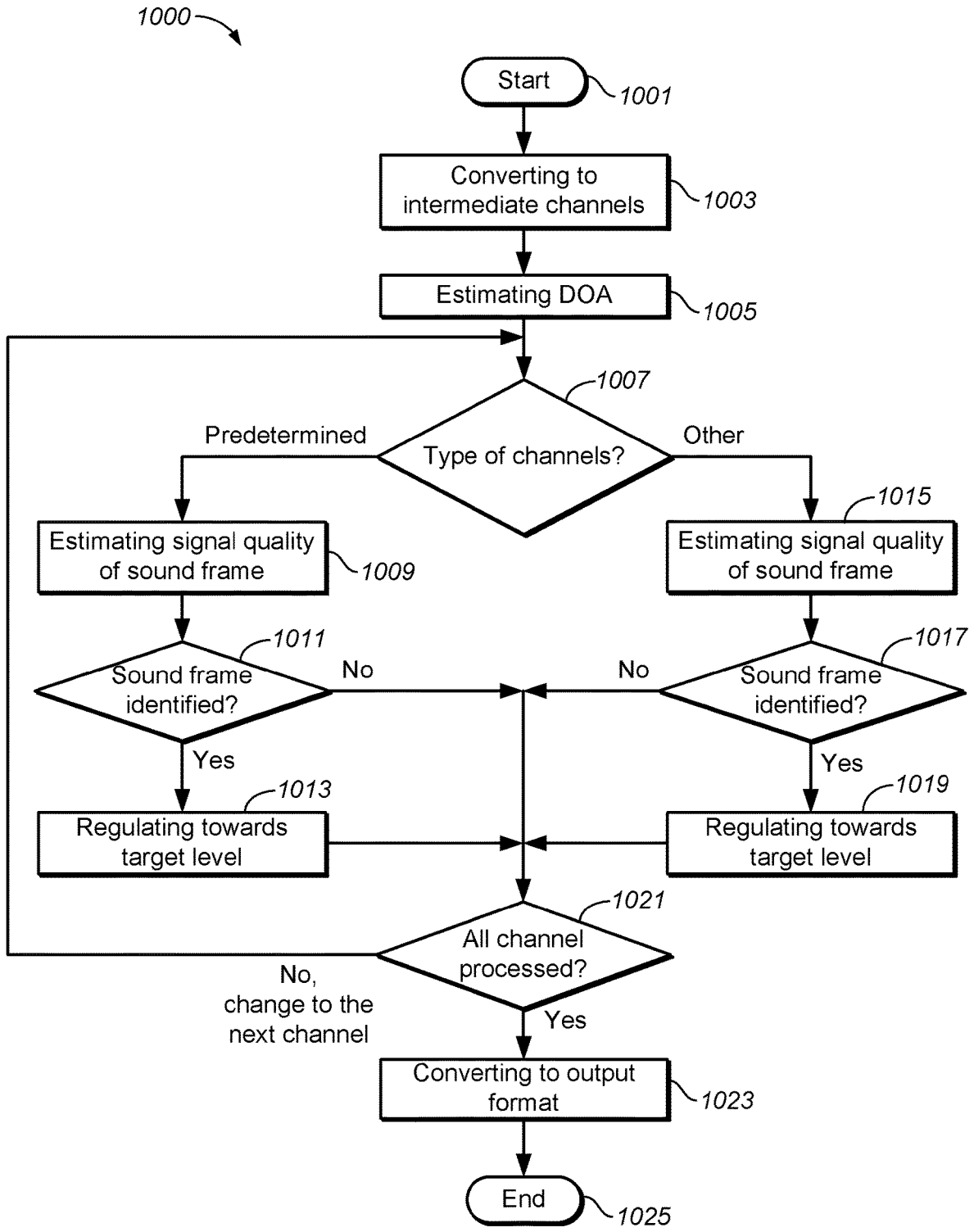
FIG. 10 is a flow chart for illustrating an example method of processing audio signals according to an example embodiment.

FIG. 10 is a flow chart for illustrating an example method 1000 of processing audio signals according to an example embodiment.

As illustrated in FIG. 10, the method 1000 starts from step 1001. At step 1003, at least two input sound channels captured via a microphone array are converted into at least two intermediate sound channels. The intermediate sound channels are respectively associated with predetermined directions from the microphone array. In each of the intermediate sound channels, if a sound source is closer to the direction associated with the intermediate sound channel, the sound source is more enhanced in the intermediate sound channel. In an example, the intermediate sound channels may be produced by applying beamforming to input sound channels captured via microphones of a microphone array.

At step 1005, a direction of arrival is estimated based on input sound frames of the input sound channels captured via the microphone array.

At step 1007, it is determined whether a current one of the intermediate sound channels is predetermined intermediate sound channel or not. A predetermined intermediate sound channel may be that associated with a direction in which a sound source closer to the microphone array is expected to present. Alternatively, a predetermined intermediate sound channel may be that associated with a direction in which a sound source farther to the microphone array is expected to present. In an example, a predetermined intermediate sound channel may be specified based on configuration data or user input.

If the intermediate sound channel is a predetermined intermediate sound channel, then at step 1009, the signal quality of a sound frame in the predetermined intermediate sound channel is estimated.

At step 1011, presence of a sound source, locating near the direction associated with the predetermined intermediate sound channel, in a sound frame of the predetermined intermediate sound channel is identified. In an example, the presence can be identified if a sound source presents near the direction associated with the predetermined intermediate sound channel and the sound emitted by the sound source is sound of interest (SOI) other than background noise and microphone noise. For example, the sound of interest may be identified as non-stationary sound. As an example, the signal quality may be used to identify the sound of interest. If the signal quality of a sound frame is higher, there is a larger possibility that the sound frame includes the sound of interest. In an example, the signal quality of a sound frame in the predetermined intermediate sound channel is estimated, and a sound frame is identified if the following conditions are met: 1) the direction of arrival indicates that a sound source of the sound frame locates within a predetermined range from the direction associated with the predetermined intermediate sound channel including the identified sound frame, and 2) the signal quality is higher than a threshold level. In condition 1), the sound frame is associated with the same time as the input sound frames for estimating the direction of arrival to ensure that the direction of arrival really indicates the location when the sound source emits the sound of interest in the sound frame.

In an example, more than one direction of arrival may be estimated for more than one sound source at the same time. In this situation, with respect to each direction of arrival, the signal quality of a sound frame in the predetermined intermediate sound channel is estimated, and a sound frame is identified if the conditions 1) and 2) are met.

If a sound frame is not identified at step 1011, then the method 1000 proceeds to step 1021. If a sound frame is identified at step 1011, then at step 1013, a sound level of the identified sound frame is regulated towards a target level, by applying a corresponding gain, and then the method 1000 proceeds to step 1021.

If the intermediate sound channel is not a predetermined intermediate sound channel, then at step 1015, the signal quality of a sound frame in each intermediate sound channel other than the predetermined intermediate sound channel(s) is estimated.

At step 1017, a sound frame is identified if the signal quality is higher than a threshold level. If a sound frame in an intermediate sound channel other than the predetermined intermediate sound channel(s) is identified at step 1017, then at step 1019, a sound level of the identified sound frame is regulated towards another target level, by applying a corresponding gain, and then the method 1000 proceeds to step 1021. If a sound frame in an intermediate sound channel other than the predetermined intermediate sound channel(s) is not identified at step 1017, the method 1000 proceeds to step 1021.

At step 1021, it is determined whether all the intermediate sound channels have been processed. If not, the method 1000 proceeds to step 1007 and changes the current intermediate sound channel to the next intermediate sound channel waiting for processing. If all the intermediate sound channels have been processed, the method 1000 proceeds to step 1023.

At step 1023, the intermediate sound channels subjected to leveling are converted to a predetermined output channel format. Then the method 1000 ends at step 1025.

The target level and/or the gain for regulating an identified sound frame in a predetermined intermediate sound channel may be identical to or different from the target level and/or gain, respectively, for regulating an identified sound frame in an intermediate sound channel other than the predetermined intermediate sound channel, depending on the purpose of sound leveling. In an example, if a predetermined intermediate sound channel is associated with a direction in which a sound source closer to the microphone array is expected to present (for example, the back channel in FIG. 5A), the target level and/or the gain for regulating an identified sound frame in the predetermined intermediate sound channel is lower than the target level and/or gain, respectively, for regulating an identified sound frame in an intermediate sound channel other than the predetermined intermediate sound channel. In another example, if a predetermined intermediate sound channel is associated with a direction in which a sound source farther to the microphone array is expected to present (for example, the front channel in FIG. 5A), the target level and/or the gain for regulating an identified sound frame in the predetermined intermediate sound channel is higher than the target level and/or gain, respectively, for regulating an identified sound frame in an intermediate sound channel other than the predetermined intermediate sound channel.

Figure 11:
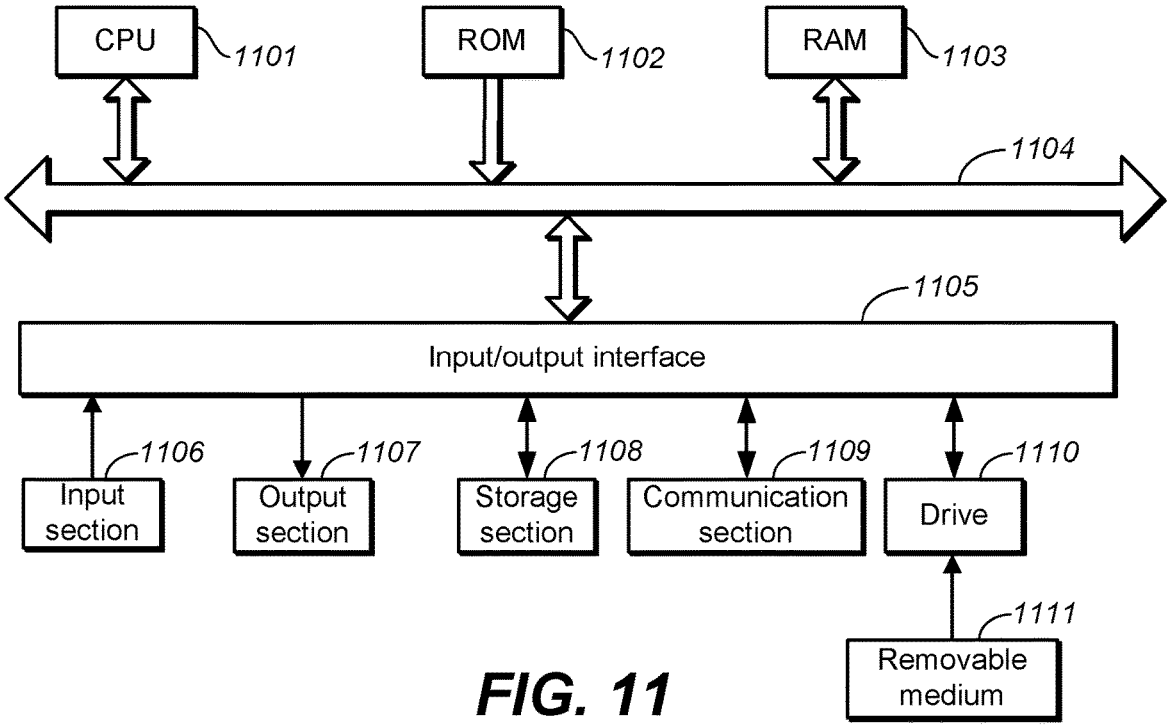
FIG. 11 is a block diagram illustrating an example system for implementing the aspects of the example embodiments disclosed herein.

FIG. 11 is a block diagram illustrating an exemplary system 1100 for implementing the aspects of the example embodiments disclosed herein.

In FIG. 11, a central processing unit (CPU) 1101 performs various processes in accordance with a program stored in a read only memory (ROM) 1102 or a program loaded from a storage section 1108 to a random access memory (RAM) 1103. In the RAM 1103, data required when the CPU 1101 performs the various processes or the like is also stored as required.

The CPU 1101, the ROM 1102 and the RAM 1103 are connected to one another via a bus 1104. An input/output interface 1105 is also connected to the bus 1104.

The following components are connected to the input/output interface 1105: an input section 1106 including a keyboard, a mouse, or the like; an output section 1107 including a display such as a cathode ray tube (CRT), a liquid crystal display (LCD), or the like, and a loudspeaker or the like; the storage section 1108 including a hard disk or the like; and a communication section 1109 including a network interface card such as a LAN card, a modem, or the like. The communication section 1109 performs a communication process via the network such as the internet.

A drive 1110 is also connected to the input/output interface 1105 as required. A removable medium 1111, such as a magnetic disk, an optical disk, a magneto-optical disk, a semiconductor memory, or the like, is mounted on the drive 1110 as required, so that a computer program read therefrom is installed into the storage section 1108 as required.

In the case where the above—described steps and processes are implemented by the software, the program that constitutes the software is installed from the network such as the internet or the storage medium such as the removable medium 1111.

Various aspects of the present invention may be appreciated from the following enumerated example embodiments (EEEs):

EEE1. A method of processing audio signals, comprising:

converting, by a processor, at least two input sound channels captured via a microphone array into at least two intermediate sound channels, wherein the intermediate sound channels are respectively associated with predetermined directions from the microphone array, and the closer to the direction a sound source is, the more the sound source is enhanced in the intermediate sound channel associated with the direction;

leveling, by the processor, the intermediate sound channels separately; and converting, by the processor, the intermediate sound channels subjected to leveling to a predetermined output channel format.

EEE2. The method according to EEE 1, further comprising:

estimating, by the processor, a direction of arrival based on input sound frames of at least two of the input sound channels, and wherein the leveling comprises:

for each of at least one predetermined intermediate sound channel of the intermediate sound channels, estimating a first signal quality of a first sound frame in the predetermined intermediate sound channel, wherein the first sound frame is associated with the same time as the input sound frames;

identifying the first sound frame if the direction of arrival indicates that a sound source of the first sound frame locates within a predetermined range from the predetermined direction associated with the predetermined intermediate sound channel including the identified first sound frame, and the first signal quality is higher than a first threshold level; and regulating a sound level of the identified first sound frame towards a first target level.

EEE3. The method according to EEE 2, wherein the first target level is lower than at least one target level for leveling the rest of the intermediate sound channels other than the at least one predetermined intermediate sound channel.

EEE4. The method according to EEE 2 or EEE 3, further comprising:

specifying, by the processor, the at least one predetermined intermediate sound channel based on configuration data or user input.

EEE5. The method according to any of the EEEs 2-4, wherein the microphone array is arranged in a voice recording device, a source locating in the direction associated with the at least one predetermined intermediate sound channel is closer to the microphone array than another source locating in the direction associated with the at least one intermediate sound channel other than the at least one predetermined intermediate sound channel, and the first target level is lower than the second target level.

EEE6. The method according to EEE 5, wherein the voice recording device is adapted for a conference system.

EEE7. The method according to any of the EEEs 2-6, wherein the predetermined output channel format is selected from a group consisting of mono, stereo, 5.1 or higher, and first order or higher order ambisonic.

EEE8. The method according to any of the EEEs 1-7, wherein the leveling further comprises:

estimating a second signal quality of a second sound frame in at least one of the intermediate sound channels other than the at least one predetermined intermediate sound channel;

identifying the second sound frame if the second signal quality is higher than a second threshold level; and regulating a sound level of the identified second sound frame towards a second target level.

EEE9. The method according to EEE 8, wherein the microphone array is arranged in a portable electronic device including a camera, the input sound channels are captured during capturing a video via the camera, the at least one predetermined intermediate sound channel comprises a back channel associated with a direction opposite to the orientation of the camera, and the at least one of the intermediate sound channels other than the at least one predetermined intermediate sound channel comprises a front channel associated with a direction coinciding with the orientation of the camera.

EEE10. The method according to EEE 9, wherein the first target level is lower than the second target level, or the first target level is higher than the second target level.

EEE11. The method according to any of the EEEs 1-10, wherein the converting of the at least two input sound channels comprises:

applying, by the processor, beamforming on the input sound channels to produce the intermediate sound channels.

EEE12. An audio signal processing device comprising:

a processor; and a memory associated with the processor and comprising processor-readable instructions such that when the processor reads the processor-readable instructions, the processor executes the method according any one of EEEs 1-11.

EEE13. An audio signal processing device, comprising:

at least one hardware processor which executes:

a first converter configured to convert at least two input sound channels captured via a microphone array into at least two intermediate sound channels, wherein the intermediate sound channels are respectively associated with predetermined directions from the microphone array, and the closer to the direction a sound source is, the more the sound source is enhanced in the intermediate sound channel associated with the direction;

a leveler configured to level the intermediate sound channels separately; and a second converter configured to convert the intermediate sound channels subjected to leveling to a predetermined output channel format.

EEE14. The audio signal processing device according to EEE 13, wherein the hardware processor further executes:

a direction of arrival estimator configured to estimate a direction of arrival based on input sound frames of at least two of the input sound channels, and a detector configured to, for each of at least one predetermined intermediate sound channel of the intermediate sound channels, estimate a first signal quality of a first sound frame in the predetermined intermediate sound channel, wherein the first sound frame is associated with the same time as the input sound frames; and identify the first sound frame if the direction of arrival indicates that a sound source of the first sound frame locates within a predetermined range from the predetermined direction associated with the predetermined intermediate sound channel including the identified first sound frame, and the first signal quality is higher than a first threshold level, and the leveler is further configured to regulate a sound level of the identified first sound frame towards a first target level.

EEE15. The audio signal processing device according to EEE 14, wherein the detector is further configured to:

estimate a second signal quality of a second sound frame in at least one of the intermediate sound channels other than the at least one predetermined intermediate sound channel; and identify the second sound frame if the second signal quality is higher than a second threshold level, and wherein the leveler is further configured to regulate a sound level of the identified second sound frame towards a second target level.

What is claimed is:

1. A method of processing audio signals, comprising:

converting, by a processor, at least two input sound channels captured via a microphone array into at least two intermediate sound channels, wherein the intermediate sound channels are respectively associated with predetermined directions from the microphone array, and the closer to the direction a sound source is, the more the sound source is enhanced in the intermediate sound channel associated with the direction;

leveling, by the processor, the intermediate sound channels separately; and converting, by the processor, the intermediate sound channels subjected to leveling to a predetermined output channel format, further comprising:

estimating, by the processor, a direction of arrival based on input sound frames of at least two of the input sound channels, and wherein the leveling comprises:

for each of at least one predetermined intermediate sound channel of the intermediate sound channels, estimating a first signal quality of a first sound frame in the at least one predetermined intermediate sound channel, wherein the first sound frame is associated with the same time as the input sound frames;

identifying the first sound frame if the direction of arrival indicates that a sound source of the first sound frame is located within a predetermined range from the predetermined direction associated with the at least one predetermined intermediate sound channel including the identified first sound frame, and the first signal quality is higher than a first threshold level; and regulating a sound level of the identified first sound frame towards a first target level, by applying a first gain.

2. The method according to claim 1, wherein the first target level and/or the first gain is lower than at least one target level and/or gain, respectively, for leveling the rest of the intermediate sound channels other than the at least one predetermined intermediate sound channel.

3. The method according to claim 1, further comprising:

specifying, by the processor, the at least one predetermined intermediate sound channel based on configuration data or user input.

4. The method according to claim 1, wherein the predetermined output channel format is selected from a group consisting of mono, stereo, 5.1 or higher, and first order or higher order ambisonic.

5. The method according to claim 1, wherein the leveling further comprises:

estimating a second signal quality of a second sound frame in at least one of the intermediate sound channels other than the at least one predetermined intermediate sound channel;

identifying the second sound frame if the second signal quality is higher than a second threshold level; and regulating a sound level of the identified second sound frame towards a second target level, by applying a second gain.

6. The method according to claim 5, wherein the microphone array is arranged in a voice recording device, a source located in the direction associated with the at least one predetermined intermediate sound channel is closer to the microphone array than another source located in the direction associated with the at least one intermediate sound channel other than the at least one predetermined intermediate sound channel, and the first target level is lower than the second target level and/or the first gain is lower than the second gain.

7. The method according to claim 6, wherein the voice recording device is adapted for a conference system.

8. The method according to claim 5, wherein the microphone array is arranged in a portable electronic device including a camera, the input sound channels are captured during capturing a video via the camera, the at least one predetermined intermediate sound channel comprises a back channel associated with a direction opposite to the orientation of the camera, and the at least one of the intermediate sound channels other than the at least one predetermined intermediate sound channel comprises a front channel associated with a direction coinciding with the orientation of the camera.

9. The method according to claim 8, wherein:

the first target level and/or the first gain is lower than the second target level and/or the second gain respectively, or the first target level and/or the first gain is higher than the second target level and/or the second gain respectively.

10. The method according to claim 1, wherein the converting of the at least two input sound channels comprises:

applying, by the processor, beamforming on the input sound channels to produce the intermediate sound channels.

11. The method according to claim 1, wherein said estimating the first signal quality, and optionally said estimating the second signal quality as well, comprises calculating a signal-to-noise ratio (SNR) of the respective sound frame.

12. The method according to claim 11, wherein the first signal quality, and optionally the second signal quality as well, is represented by an instantaneous signal-to-noise ratio determined by: estimating a noise floor of the respective sound frame and determining at least one of a ratio of the current level of the respective sound frame and the noise floor; and a difference between the current level of the respective sound frame and the noise floor.

13. An audio signal processing device comprising:

a processor; and a memory associated with the processor and comprising processor-readable instructions such that when the processor reads the processor-readable instructions, the processor executes the method according to claim 1.

14. Computer program product having instructions which, when executed by a computing device or system, cause said computing device or system to perform the method according to claim 1.

15. An audio signal processing device, comprising:

at least one hardware processor which executes:

a first converter configured to convert at least two input sound channels captured via a microphone array into at least two intermediate sound channels, wherein the intermediate sound channels are respectively associated with predetermined directions from the microphone array, and the closer to the direction a sound source is, the more the sound source is enhanced in the intermediate sound channel associated with the direction;

a leveler configured to level the intermediate sound channels separately; and a second converter configured to convert the intermediate sound channels subjected to leveling to a predetermined output channel format, wherein the hardware processor further executes:

a direction of arrival estimator configured to estimate a direction of arrival based on input sound frames of at least two of the input sound channels, and a detector configured to, for each of at least one predetermined intermediate sound channel of the intermediate sound channels, estimate a first signal quality of a first sound frame in the at least one predetermined intermediate sound channel, wherein the first sound frame is associated with the same time as the input sound frames; and identify the first sound frame if the direction of arrival indicates that a sound source of the first sound frame is located within a predetermined range from the predetermined direction associated with the at least one predetermined intermediate sound channel including the identified first sound frame, and the first signal quality is higher than a first threshold level, and wherein the leveler is further configured to regulate a sound level of the identified first sound frame towards a first target level by applying a first gain.

16. The audio signal processing device according to claim 15, wherein the detector is further configured to:

estimate a second signal quality of a second sound frame in at least one of the intermediate sound channels other than the at least one predetermined intermediate sound channel; and identify the second sound frame if the second signal quality is higher than a second threshold level, and wherein the leveler is further configured to regulate a sound level of the identified second sound frame towards a second target level by applying a second gain.

* * * * *